United States Patent [19]

Deaton et al.

[11] 4,214,606

[45] Jul. 29, 1980

[54] SUBSURFACE SAFETY VALVE

[75] Inventors: Thomas M. Deaton; Gary A. Kohn, both of Dallas, Tex.

[73] Assignee: Otis Engineering Corporation, Dallas, Tex.

[21] Appl. No.: 903,785

[22] Filed: May 8, 1978

[51] Int. Cl.[2] ..... E21B 43/12; F16K 31/163

[52] U.S. Cl. ..... 137/495; 166/322; 251/63.5

[58] Field of Search ..... 166/321, 322, 323, 324; 251/62, 63.5, 63.6; 137/494, 495

[56] References Cited

U.S. PATENT DOCUMENTS

| | | | |
|---|---|---|---|
| Re. 25,471 | 11/1963 | Fredd | 166/321 |
| 2,998,077 | 8/1961 | Keithahn | 251/62 |
| 3,007,669 | 11/1961 | Fredd | 166/321 |
| 3,606,927 | 9/1971 | True et al. | 166/321 |
| 3,724,475 | 4/1973 | Ruppel | 251/62 |
| 3,732,925 | 5/1973 | Kanady | 251/63.5 |
| 3,741,249 | 6/1973 | Leutwyler | 166/324 |
| 3,854,502 | 12/1974 | Mott | 166/324 |
| 3,868,995 | 3/1975 | Crowd | 166/324 |
| 3,993,136 | 11/1976 | Mott | 166/324 |
| 4,074,761 | 2/1978 | Mott | 166/324 |
| 4,140,153 | 2/1979 | Deaton | 166/324 |
| 4,149,698 | 4/1979 | Deaton | 251/63.6 |

*Primary Examiner*—Martin P. Schwadron
*Assistant Examiner*—A. Michael Chambers
*Attorney, Agent, or Firm*—Vinson & Elkins

[57] ABSTRACT

A subsurface safety valve assembly for connection in a well pipe, including a valve member disposed in a valve body having a bore or passageway therethrough, a pair of spaced apart and oppositely facing valve seats in surrounding relation to an intermediate portion of the passageway, the valve positioned thereat and operable to open and close said passageway, a space within the valve body outwardly of the passageway therethrough, a control frame guidably movable within the space and having a piston associated therewith adapted to define first and second variable capacity pressure chambers within the space, means for moving the control frame in opposite longitudinal directions to open and close the valve, the means for moving the control frame including first and second ports, the first port providing fluid communication between the first variable capacity pressure chamber and an external source of pressure fluid, the second port providing fluid communication between the second variable capacity pressure chamber and the passageway through the valve body.

6 Claims, 4 Drawing Figures

SUBSURFACE SAFETY VALVE

BACKGROUND OF THE INVENTION

A. Field of the Invention

This invention relates to wire line removable ball type subsurface safety valves utilized to control flow at a subsurface location in a well.

B. The Prior Art

The present invention is related to wire line removable ball type subsurface safety valves referred to by Otis Engineering Corporation as type "A", as illustrated on page 3821 of the 1968-1969 Composite Catalog of Oil Field Equipment and Services.

These valves have been extensively used in wells for many years and are still being used today. In the intervening years, however, improvements have been made in the design of the ball type subsurface safety valve. One of the more significant improvements has been the provision of "pump through" capability. That is to say, in the event there is a loss of control pressure, the ball valve will rotate to the closed position, with the operator then being able to pump down fluids at a pressure sufficient to unseat the ball and thus, allowing the well to be killed, if that is desired.

Prior valves such as the type "A" valve do not have a pump through feature or means to utilize a pump down fluid to actuate the ball valve to the full open position. Although fluid could be pumped through the valve from the surface the valve only partially opens when pumping through it and thus, it is possible to cut the seat and/or ball and damage it. For this reason, such pump down of fluids were done only as an emergency operation.

An object of the present invention is to provide a valve of the general character described above modified to provide a pump through capability.

Another object is to provide a valve of the general character described above which is modified in such manner as to avoid the necessity of replacing or redesigning the valve in order to have a pump through capability.

Yet another object of the present invention is to provide a valve of the general character above-described wherein the pump-through fluid is first utilized to move the valve into a full open position, after which said fluid flows through the open valve to the area therebelow.

Another object is to provide a valve of the general character described wherein the pump-through fluid actuates an actuator or control frame to move the valve into a full open position and at the same time closes off the fluid port which normally conducts pressure fluid to the valve to control its operation.

Other objects, advantages and features of this invention will be apparent to one skilled in the art upon a consideration of the written specification, the attached claims and the annexed drawings.

SUMMARY OF THE INVENTION

The present invention is directed to an improved subsurface safety valve comprising a valve body having a bore passageway therethrough, a pair of spaced apart and oppositely facing valve seats in surrounding relation to an intermediate portion of the passageway, a valve member having an opening therethrough and seatable between the seats for opening and closing the passageway upon rotation of the valve about an axis transverse to the opening therethrough, a space within the valve body outwardly of the passageway therethrough, a control frame movable within the space and having a piston associated therewith adapted to define first and second variable capacity pressure chambers within the space, means for moving said control frame in opposite longitudinal directions within the valve body to rotate said valve member between opened and closed positions, said means for moving the control frame including first and second ports, the first port providing fluid communication between the first variable capacity pressure chamber and an external source of pressure fluid, the second port providing fluid communication between the second variable capacity pressure chamber and the bore passageway through the valve body, and the control frame and associated piston be adapted to respond to the greater of the pressure fluid or bore pressure, whereby the valve member may be maintained in an opened position.

In the preferred embodiment of the invention the control frame includes a first piston and a separately responsive, associated piston slidably movable within said space in the valve body. The separately responsive, associated pistion is slidably movable within the space in the valve body, carries a plurality of seal means, and coacts with said first piston in sealed relation to partition said first and second variable capacity chambers.

DESCRIPTION OF THE PREFERRED EMBODIMENTS

In the drawings, wherein like reference characters are used throughout to designate like parts:

FIGS. 1*a* and 1*b* are longitudinal sectional views of the upper and lower portions, respectively, of a subsurface safety valve constructed and modified in accordance with the present invention, and with the valve member thereof in fully opened position.

The major components and the method of operation of the subsurface safety valve, without the modifications described herein, referred to hereinabove as type "A" is old and well known in the art. It is not deemed necessary to describe in every detail the subassemblies and their method of operation in the detail as would normally be required. For a detailed description of the normal manner of assembly of the valves of the "A" type, attention is directed to U.S. Pat. No. 3,007,669 and related patents dealing with valves of this type. The present invention resides principally in the methods and in the associated sub-assembly of the valves described hereinafter which modifies the valves generally referred herein as the "A" type, in order to provide a pump down capability, which is a significant improvement over the basic "A" type valves.

Figure 3:
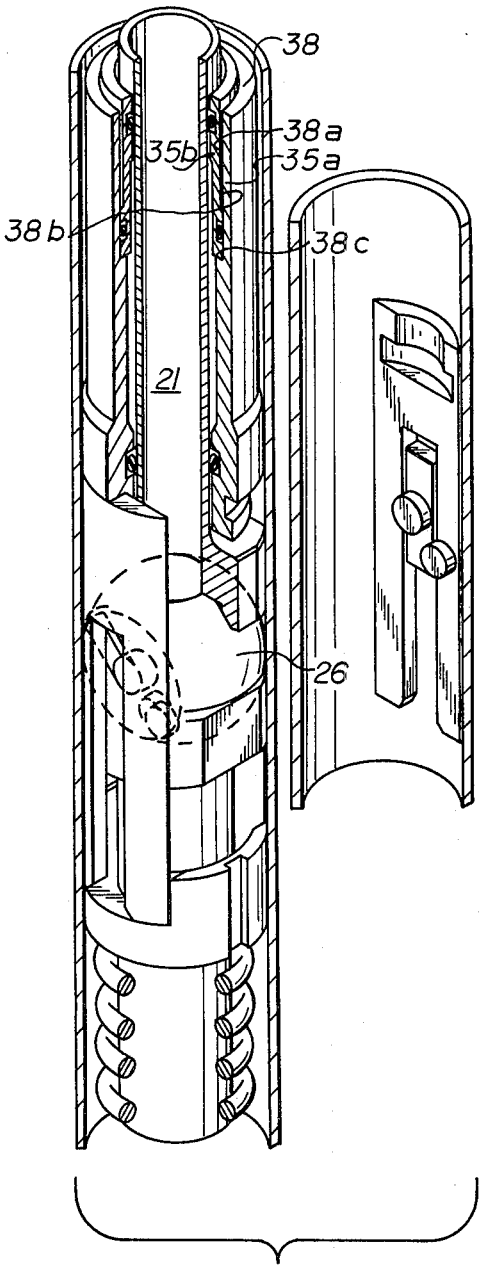
FIG. 3 is a partial perspective view, partially cut away, of the subsurface valve of the present invention, with the modification illustrated in FIG. 1*a*.

Referring in detail to the above-described drawings, the valve illustrated in FIGS. 1*a*, 1*b* and 3 comprises a valve body 20 having a bore or passageway 21 therethrough and a longitudinally extending sleeve portion 22 threadedly connected at its upper end to retaining sub 23 and connected to the spring housing 24 at its lower end, in a manner to be described hereinafter.

Disposed substantially concentrically within the sleeve 22 of the valve body and in surrounding relation to the passageway 21 are a pair of spaced apart and oppositely facing spherical seats 25 and 25*a*. A ball valve member 26 having an opening 27 therethrough is seatable between the seats 25 and 25*a* for rotation about an axis transverse to the axis of the opening 27 between opened (left hand side of FIG. 2) and closed (right hand side of FIG. 2) positions. The diameter of the opening 27 of ball valve member 26 corresponds to that of the passageway 21 so that when open, the bore through the valve is straight-through and "full-opening."

First and second tubular members 28 and 29 are arranged substantially coaxially of one another and concentrically within the bore 21 of the sleeve 22 of the valve body and an annular space 30 is provided therebetween. Seats 25 and 25*a* are formed on the oppositely facing ends of the tubular members 28 and 29, respectively.

Tubular member 29 is guidably movable longitudinally within the valve body. Tubular member 28 is guidably movable longitudinally within the valve body in sealed relation thereto so as to close end 30*a* of the space 30. That is to say, an O-ring 31 or other sealing member is received within an enlarged diameter portion 32 of the sub 23 to form a sliding seal with the upper end of the tubular member 28. Preferably, the O-ring 31 is seated, in enlarged diameter position 32 of the sub 23, with back-up ring 31*a*.

In the present invention,.it is generally preferred to seat O-rings, which are located in enlarged diameter spaces, along with back-up rings, as described hereinabove.

The valve member 26 is rotated between closed and fully opened positions by means of a cylindrical actuator or control frame 35, which consists of two cylindrical sub-assemblies, which are the major piston 35*a* and the upper associated piston 35*b*. The control frame 35 is longitudinally reciprocable within the enclosed annular. The control frame 35 is sealably slidable within the annular to define a variable capacity pressure chamber 37 between the pressure response surfaces 38, 38*a*, 38*b* and 38*d* of the major piston 35*a* and upper piston 35*b* and the closed upper end 30*a* of the space. Both the upper associated piston 35*b* and major piston 35*a* are downwardly responsive to a pressure fluid or hydraulic fluid pressure within the variable capacity pressure chamber 37, with the fluid acting upon pressure responsive surfaces 38, 38*a*, 38*b* and 38*d*.

For assembly purposes, the control frame 35 is made up of a plurality of separate parts which may be assembled into the integral unit shown in the drawings. More particularly, the upper portion of the major piston 35*a*, as illustrated in FIG. 1*a*, is superimposed upon and surrounds the upper associated piston 35*b*. The associated pistons 35*a* and 35*b* of the control frame 35 are movable above the valve seat 25 longitudinally within the space 30 and are connected to an intermediate portion 53 of the control frames by means of a T-slot connection 54. The enlarged ends of the tubular members 28 and 29 upon which seats 25 and 25*a* are formed are machined away so as to permit the intermediate portion 53 of the control frame to be extended along opposite sides of the valve member 26 between said valve member and the sleeve portion 22 of the valve body 20.

The valve member 26 is connected to the above described control frame 35 for rotation between closed and fully opened positions and responds to reciprocation of the control frame longitudinally within the annular space 30. More particularly, the valve member is rotated to close position upon the exhaust of control fluid from the chamber 37 to move the frame into its upper most position, (further upward movement is prevented by the engagement of stop member 12 with the closed end 30*a* of space 30). Stop member 12 is retained upon tubular member 28 by means of snap ring 13 as illustrated in the drawing. On the other hand, the valve member is rotated to fully open position, as shown in FIG. 1*a*, upon the admission of such fluid into the chamber 37 to move the frame into its lower most position.

Figure 1A:
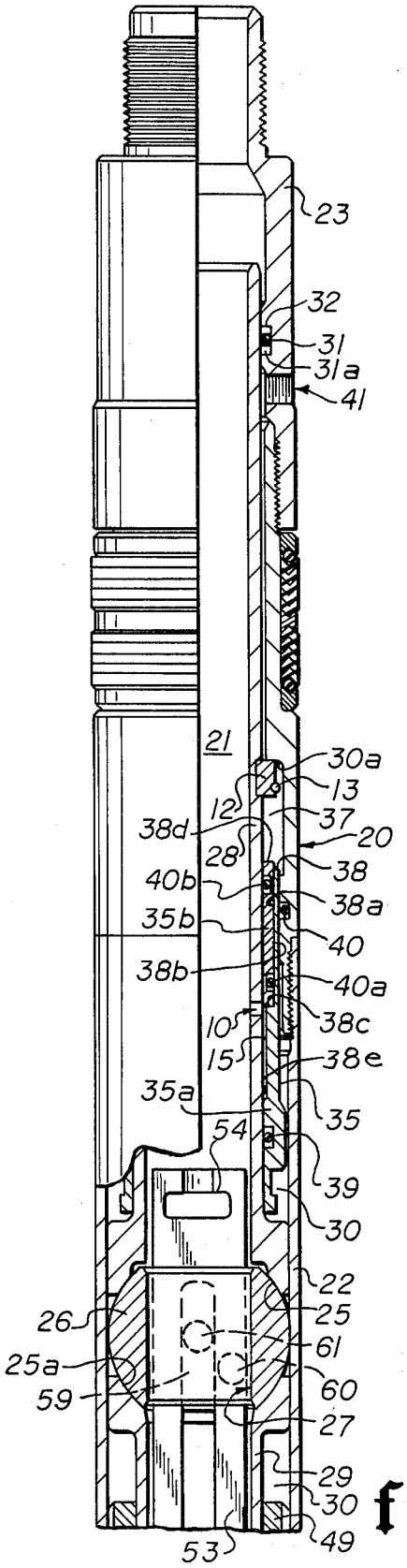

The valve member 26 as illustrated in FIG. 1*a*, is moved from its open to its closed position by an arrangement of slots and cams in the following manner. There is included substantially rectangularly shaped cam slots 59 formed in opposite sides of the valve member 26 extending transversely to the axis of rotation of the valve member, and cam lug 60 on the control frame and cam lug 61 fixedly mounted in the valve body 22 operatively engaged within the slot 59. More particularly the cam slots 59 extend across the axis of rotation of the ball-shaped valve member 26 and each of the cam lugs 60 and 61 is mounted on the control frame 35 and valve body 22, respectively for the engagement with the cam slots upon opposite sides of the axis of rotation of the valve member. Thus, upon reciprocation of the control frame in the manner above-described, the valve member is caused by cam lug 60 to pivot about an axis defined by the cam lugs 61 mounted in the valve body, with cam lugs 60 and 61 sliding toward and away from one another within the cam slot 59. Cam lug 60 and 61 offset on opposite sides of the rotational axis of the valve member 26, said valve member, and thus the seats 25 and 25*a* will move longitudinally between open and closed positions a distance less than longitudinal movement of the control frame. That is, with the lugs spaced equally on opposite sides of the axis, the longitudinal movement of the valve member will be one-half that of the control frame. In the illustrated embodiment of the valve, the cam lugs 61 are only one-half as far from the axis as are the cam lugs 60, so that the longitudinal movement of the valve member and seats is only one-third that of the control frame. This arrangement of slots and cams as used on the A-type valves is well known in the art and further explanation is not deemed necessary.

The control frame 35 carries a series of O-ring seals which are located on or in association with the upper associated piston 35*b* and major control frame 35*a* in the following manner. The inner diameter of the control frame 35*a* carries an O-ring 39 sealably slidable with respect to the outer diameter of tubular member 28. The upper piston 35*b*, illustrated in FIG. 1*a*, carries two O-rings 40*a* and 40*b*, with O-ring 40*a* being carried upon the outer surface of piston 35*b* and O-ring 40*b* being carried upon the inner surface of piston 35*b*. O-ring 40*b* is sealably slidable with respect to the outer diameter of tubular member 28, and O-ring 40*a* is sealably slidable with respect to inner face 38*a* of major control frame 35*a*.

In one embodiment of the invention, a portion of major control frame 35*a* overlaps and surrounds upper piston 35*b*. It is the inner face 38*a* of major control frame 35*a* which defines this surrounding relationship to piston 35*b*, as illustrated in FIGS. 1*a* and 3. An O-ring 40, on the inner surface of tubular member 22, provides a sliding seal between the outer surface of major control frame 35*a* and the inner diameter of tubular member 22.

There is provided a port 10 extending from the bore or passageway 21 through tubular member 28 providing fluid communication between passageway 21 and second variable capacity pressure chamber 15. When fluid is pumped down the passageway 21 in order to rotate ball valve 26 to the open position, fluid passes through port 10 into the variable capacity pressure chamber 15 which causes upper piston 35*a* to move in an upward direction with the control fluid access entering at the upper end 30*a* of the variable capacity control chamber 37. The pressure on pressure responsive surfaces 38*c* and 38*e* is sufficient to cause the major control frame 35*a* to move in a downward direction rotating ball 26 to the open position.

A port 41 is provided through the upper sub 23 for communication with the variable capacity pressure chamber 37. In the present invention, under normal operating conditions, the pressure fluid admitted to chamber 37 through port 41 urges the control frame 35 in a downward direction, which action rotates valve 26 to the open position.

It is deemed that the control fluid used in the present invention will be hydraulic so that the pressure fluid admitted to the chamber 37 through port 41 will urge the control frame 35 in a downward direction, while the exhaust of such control fluid, which relieves the pressure on the pressure responsive surfaces 38 and 38*d* of control frame 35, will permit the frame to be moved in an opposite, or upward, direction.

Control fluid may be supplied from any suitable source, such as a location remote from the valve, and selectively admitted to or exhausted from the pressure chamber 37 by either manual or automatic means. In the latter case, such control may be made responsive to a predetermined condition at the source of the control fluid or another location. In the case of a subsurface valve, the control fluid may be supplied through a small line or conductor, not shown, connected to the port 41 and extending upwardly to a source of such fluid at ground level, in which case, production flow would be upwardly through the valve.

Upon loss of control pressure normally entering the valve through port 41 the pressure within chamber 37 would be reduced causing valve member 26 to rotate to the closed position. In order to reopen the valve, using the modification of this invention, a fluid under pressure can be pumped down passageway 21 against the closed valve forcing the pumped down fluid to pass through port 10 into the second variable capacity pressure chamber 15. Entry of this fluid under pressure into chamber 15 causes the upper associated piston 35*b* to be moved upwardly while the piston 35*a* is forced downwardly operating the control frame 35 to open the valve 26 to the open position. This introduced pressure fluid entering through port 10 operates on piston surfaces 38*c* and 38*e*, wherein there is a sufficient differential pressure to actuate the control frame to rotate valve 26 to the open position.

Figure 2:
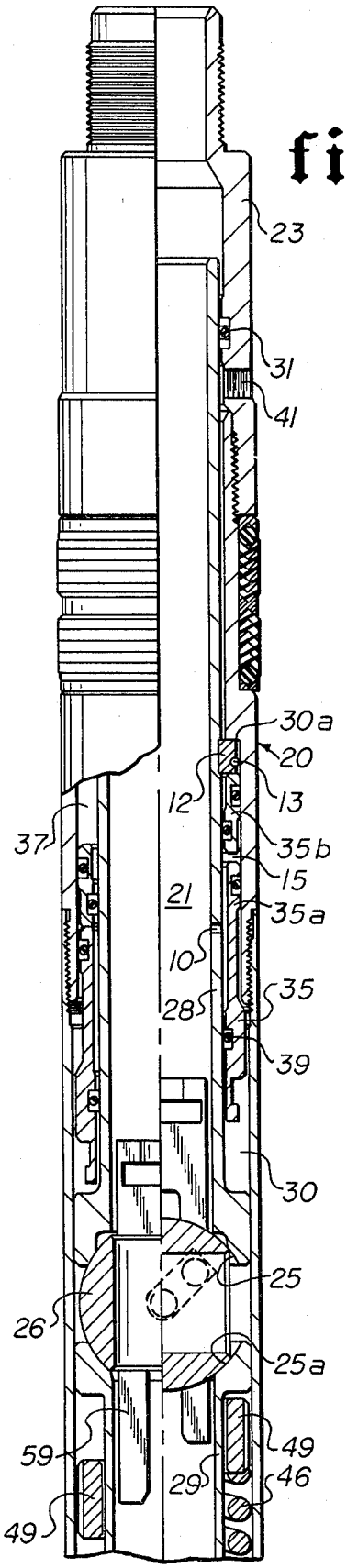
FIG. 2 is a longitudinal sectional view of the upper portion of a subsurface safety valve modified with an alternative mode of accomplishing the objects of the present invention.

In addition to the embodiment shown in FIG. 1*a* for an upper associated piston, it has been found that the piston arrangement illustrated in FIG. 2 will work essentially equally well as that shown in FIG. 1*a*. The upper associated piston 35*b* will then be an independently movable piston within space 30 having O-ring seals which will define a variable capacity pressure chamber 37 at the upper end, then, of the upper piston 35*b*. The control pressure fluid entering through port 41 then will not come in contact with control frame 35 as illustrated in FIG. 1*a*. The preferred embodiment of this invention is illustrated in FIG. 1*a*.

In the valves of this invention, the control frame 35 is urged upwardly, or in a direction opposite that toward which it is urged by control fluid within the variable capacity pressure chamber 37, and the seat 25*a* is urged into seating engagement with the valve member by spring means 46 disposed concentrically outwardly of the passageway 21 therethrough and bearing against the frame and tubular member 29, respectively. This spring means will be so designed as to exert sufficient force on the control frame to positively open or close the valve upon the relief of the pressure of the control fluid within the pressure chamber 37, while at the same time exerting a lesser force on the seat 25*a* to reduce frictional resistance to turning of the valve member.

Figure 1B:
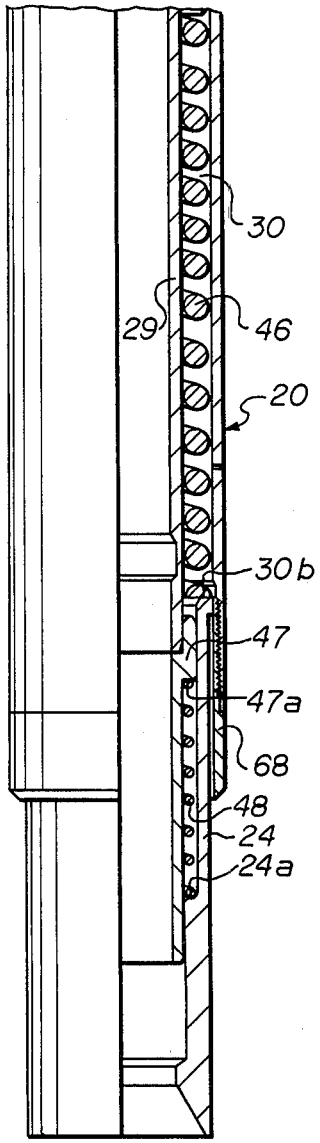

In its preferred form, as illustrated in FIGS. 1*a* and 1*b*, the spring 46 is enclosed within the space 30 defined by tubular member 29 and tubular member 22 and being disposed between closed end 30*b* of space 30 which is formed on the inner end of spring housing 24 and a thrust ring 49 disposed concentrically about tubular member 29 below seat 25*a*. Engaged with and extending below tubular member 29 is lower seat extension 47. Disposed concentrically about lower seat extension 47 is a second spring housing 24 and at its upper end against seat 47*a* of lower seat extension 47.

The spring means acts upon the control frame 35 to urge it upwardly with the relatively large force required to ensure positive movement of the valve member 26 to one of its positions.

It is to be understood that all matter herein set forth and shown in the accompanying drawings is to be interpreted as illustrative and not in a limiting sense.

The invention having been described, what is claimed is:

1. A subsurface safety valve comprising:

(a) a valve body having a bore passageway therethrough, (b) a pair of spaced apart and oppositely facing valve seats in surrounding relation to an intermediate portion of said bore passageway, (c) a valve member having an opening therethrough and seatable between said seats for opening and closing said bore passageway upon rotation about an axis transverse to the opening therethrough, (d) a tubular member extending from one of said valve seats, disposed in the bore passageway of said valve body, forming an annular space within the valve body, (e) a first variable capacity pressure chamber within said annular space for receiving control pressure fluid from a source external to the safety valve;

(f) a second variable capacity pressure chamber within said annular space for receiving pressure from the bore passageway of said safety valve, (g) a control frame longitudinally movable within said annular space, responsive to the greater of pressure in the first or second variable capacity pressure chambers for rotating said valve member to the bore open positions, (h) a piston slidably disposed between said tubular member and said control frame having seal means thereon, separating said first variable pressure chamber from said second variable capacity pressure chamber and responsive to pressure in said first variable capacity pressure chamber to allow said piston to move to a first position to coact with said control frame in rotating said valve member to a full bore open position, (i) single conduit means for conducting control pressure fluid to said first variable capacity pressure chamber, and (j) port means in said tubular member providing fluid communication between the bore passageway and said second variable capacity pressure chamber to allow pressure to move said piston to a second noncoacting position with said control frame, pressurization of either chamber moving said control frame allowing rotation of said valve member opening said bore passageway, (k) resilient means for rotating said valve member closing the bore passageway upon reduction of pressure to predetermined value acting on said control frame.

2. The subsurface safety valve of claim 1, wherein said piston and said control frame are each exposed to pressure fluid received in said first variable capacity pressure chamber.

3. The subsurface safety valve of claim 2, wherein said piston and said control frame each carry a plurality of seal means and coact in sealed relation to each other to separate said first variable capacity pressure chamber from said second variable capacity pressure chamber.

4. The subsurface safety valve of claim 1, wherein said piston is longitudinally movable in said annular space and is responsive to a pressure in said first variable capacity pressure chamber, which is greater than bore passageway pressure, to act on said control frame to rotate said valve member to the full bore open position.

5. The subsurface safety valve of claim 1, wherein said piston is longitudinally movable in a direction opposite said control frame when the pressure in said second variable capacity pressure chamber is greater than the pressure in said first variable capacity pressure chamber.

6. The subsurface safety valve of claim 1, wherein only said piston is exposed to pressure fluid received in said first variable capacity pressure chamber.

* * * * *